US005739099A

United States Patent [19]

Welch et al.

[11] Patent Number: 5,739,099

[45] Date of Patent: Apr. 14, 1998

[54] RINSE AID COMPOSITIONS CONTAINING MODIFIED ACRYLIC POLYMERS

[75] Inventors: Michael C. Welch, Woodhaven; Kenneth L. Zack; Glenis Roberts, both of Wyandotte, all of Mich.

[73] Assignee: BASF Corporation, Mount Olive, N.J.

[21] Appl. No.: 568,030

[22] Filed: Dec. 6, 1995

[51] Int. Cl.[6] ..... C11D 3/37; C11D 1/83

[52] U.S. Cl. ..... 510/514; 510/407; 510/413; 510/414; 510/434; 510/476; 510/489

[58] Field of Search ..... 510/514, 476, 510/223, 230, 434, 361, 407, 413, 414, 489

[56] References Cited

U.S. PATENT DOCUMENTS

| | | | |
|---|---|---|---|
| 4,678,596 | 7/1987 | Dupre et al. | 510/514 |
| 5,516,452 | 5/1996 | Welch et al. | 510/514 |
| 5,534,183 | 7/1996 | Gopalkrishnan et al. | 510/434 |
| 5,536,440 | 7/1996 | Gopalkrishnan et al. | 510/417 |

FOREIGN PATENT DOCUMENTS

| | | |
|---|---|---|
| 0 308 221 B1 | 4/1992 | European Pat. Off. . |
| 58-5398 | 1/1983 | Japan . |

OTHER PUBLICATIONS

CAS Registry No. 25155-30-0 computer printout, 1996.

*Primary Examiner*—Ardith Hertzog
*Attorney, Agent, or Firm*—Joanne P. Will

[57] ABSTRACT

An improved rinse aid composition comprising a blend of nonionic, cationic, anionic, zwitterionic and amphoteric surfactants, hydrotropes, and copolymers of alkylene oxide adducts of allyl alcohol and acrylic acid useful in reducing spotting and filming of dishware.

6 Claims, No Drawings

RINSE AID COMPOSITIONS CONTAINING MODIFIED ACRYLIC POLYMERS

FIELD OF THE INVENTION

This invention relates to rinse aid compositions containing certain copolymers of the alkylene oxide adducts of allyl alcohol and acrylic acid.

BACKGROUND OF THE INVENTION

Rinse aid formulations generally are aqueous solutions containing nonionic surfactants which promote rapid draining of water from dishware and minimize spotting-and-filming. Under conditions of high water hardness, surfactants alone will not prevent filming. It is known that polymers of acrylic acid can improve the performance of rinse aid compositions by inhibiting deposition of mineral salts which contribute to filming of dishware.

EP0308221B1 discloses a rinse aid composition containing a low foam nonionic surfactant, an acrylic acid polymer of molecular weight 1000 to 250,000, and an additional nonionic surfactant having a cloud point of at least 70° C. to serve as a stabilizer.

U.S. Pat. No. 4,678,596 discloses a rinse aid composition containing a low foam nonionic surfactant, a low molecular weight poly(meth) acrylic acid, and a high molecular weight stabilizing polymer of methacrylic acid.

We have now surprisingly discovered that the addition of certain copolymers of the alkylene oxide adducts of allyl alcohol and acrylic acid dramatically reduce the filming of glassware under hard water conditions and the composition does not require a high cloud point nonionic surfactant or a compatibilizing polymer for stability.

SUMMARY

The present invention relates to improved rinse aid compositions comprising a blend of surfactants selected from the group consisting of anionic, cationic, nonionic, zwitterionic and amphoteric surfactants, and hydrotropes, and copolymers of alkylene oxide adducts of allyl alcohol and acrylic acid having at least one of the following formulas:

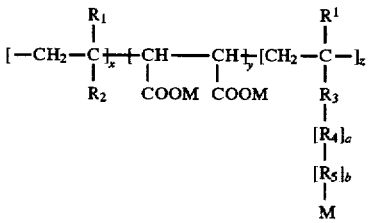

Formula I or

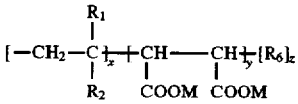

Formula II wherein x, y, z, a, and b are integers, (x+y):z is from about 5:1 to 1000:1, and y can be any value ranging from zero up to the value of x; M is an alkali metal or hydrogen; a:b is from about 1:4 to about 1:99;

$R_1$=H or $CH_3$;

$R_2$=COOM, $OCH_3$, $SO_3M$, O—CO—$CH_3$, CO—$NH_2$;

$R_3$=$CH_2$—O—, $CH_2$—N—, COO—, —O—,

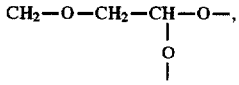

CO—NH—;

$R_4$=$C_3$ to $C_4$ alkyleneoxy group;

$R_5$=—$CH_2$—$CH_2$—O;

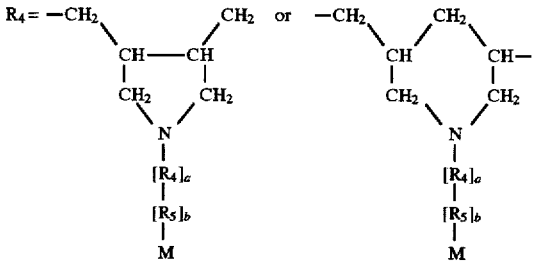

or

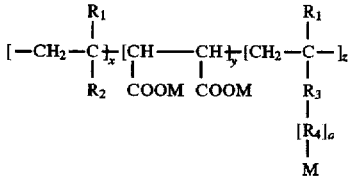

Formula III or

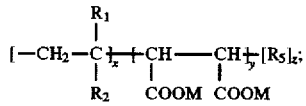

Formula IV wherein x, y and z are integers, (x+y):z is from about 5:1 to 1000:1 and y can be any value ranging from zero up to the value of x; M is an alkali metal or hydrogen; a is an integer from about 3 to about 680; and the hydrophilic and oxyethylated monomers may be in random order;

$R_1$=H or $CH_3$ $R_2$=COOM, $OCH_3$, $CO_3M$, O—CO—$CH_3$, CO—$NH_2$ $R_3$=$CH_2$—O—, $CH_2$—N—, COO—, —O—,

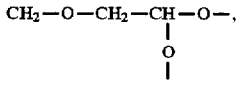

CO—NH—

$R_4$=—$CH_2$—$CH_2$—O

Where

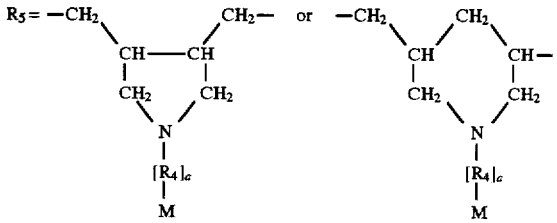

DETAILED DESCRIPTION

The compositions of the present invention are rinse aid compositions comprising a blend of surfactants selected from the group consisting of anionic, cationic, nonionic, zwitterionic, and amphoteric surfactants, and hydrotropes and copolymers of alkylene oxide adducts of allyl alcohol and acrylic acid having at least one of the following formulas:

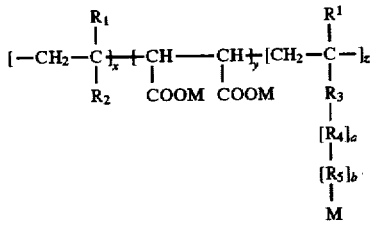

Formula I or

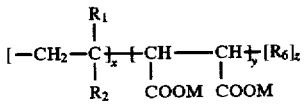

Formula II wherein x, y, z, a, and b are integers, (x+y):z is from about 5:1 to 1000:1, and y can be any value ranging from zero up to the value of x; M is an alkali metal or hydrogen; a:b is from about 1:4 to about 1:99;

$R_1$=H or $CH_3$;

$R_2$=COOM, $OCH_3$, $SO_3M$, O—CO—$CH_3$, CO—$NH_2$;

$R_3$=$CH_2$—O—, $CH_2$—N—, COO—, —O—,

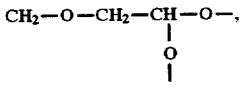

CO—NH—;

$R_4$=$C_3$ to $C_4$ alkyleneoxy group;

$R_5$=—$CH_2$—$CH_2$—O;

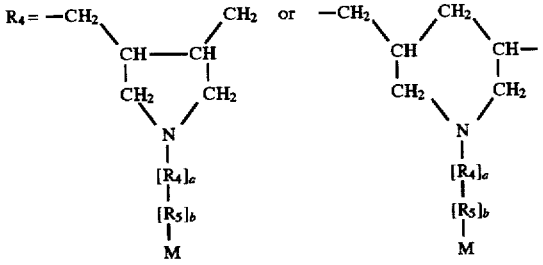

or

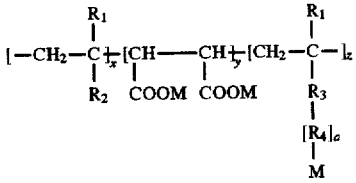

Formula III or

-continued

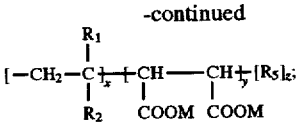

Formula IV wherein x, y and z are integers, (x+y):z is from about 5:1 to 1000:1 and y can be any value ranging from zero up to the value of X; M is an alkali metal or hydrogen; a is an integer from about 3 to about 680; and the hydrophilic and oxyethylated monomers may be in random order;

$R_1$=H or $CH_3$ $R_2$=COOM, $OCH_3$, $CO_3M$, O—CO—$CH_3$, CO—$NH_2$ $R_3$=$CH_2$—O—, $CH_2$—N—, COO—, —O—,

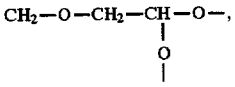

CO—NH—

$R_4$=—$CH_2$—$CH_2$—O

Where

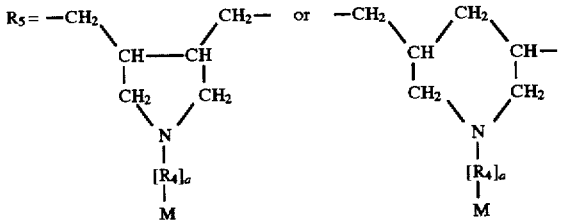

SURFACTANTS

Nonionic Surfactants

The rinse aid compositions of the present invention contain nonionic surfactants at levels of 0 to 100% by weight, preferably 1 to 80% by weight; most preferably 5 to 60% by weight. Nonionic surfactants can be broadly defined as surface active compounds which do not contain ionic functional groups. An important group of chemicals within this class are those produced by the condensation of alkylene oxide groups (hydrophilic in nature) with an organic hydrophobic compound; the latter is aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative but not limiting examples of the various chemical types of suitable nonionic surfactants include:

(a) polyoxyethylene or polyoxypropylene condensates of aliphatic carboxylic acids, whether linear or branched-chain and unsaturated or saturated, containing from about 8 to about 18 carbon atoms in the aliphatic chain and incorporating from 5 to about 50 ethylene oxide or propylene oxide units. Suitable carboxylic acids include "coconut" fatty acids (derived from coconut oil) which contain an average of about 12 carbon atoms, "tallow fatty acids (derived from tallow-class fats) which contain an average of about 18 carbon atoms, palmitic acid, myristic acid, stearic acid and lauric acid.

(b) polyoxyalkylene (polyoxyethylene or polyoxypropylene) condensates of aliphatic alcohols, whether linear- or branched- chain and unsaturated or saturated, containing from about 8 to about 24 carbon atoms and incorporating from about 5 to about 50 ethylene oxide or propylene oxide units. Suitable alcohols include the "coconut" fatty alcohol, "tallow" fatty alcohol, lauryl alcohol, myristyl alcohol and oleyl alcohol. INDUSTROL® DW5 is a preferred condensate of an aliphatic alcohol type surfactant. INDUSTROL® DW5 is available from BASF Corporation, Mt. Olive, N.J.

(c) polyoxyalkylene (polyoxyethylene or polyoxypropylene) condensates of alkyl phenols, whether linear- or branched- chain and unsaturated or saturated, containing from about 6 to about 12 carbon atoms and incorporating from about 5 to about 25 moles of ethylene oxide or propylene oxide.

(d) Particularly preferred nonionic surfactants are selected polyalkylene oxide block copolymers. This class can include polyethoxylated polypropoxylated propylene glycol sold under the tradename "PLURONIC®" made by the BASF Corporation or polypropoxylated-polyethoxylated ethylene glycol sold under the tradename "PLURONIC-R®" made by the BASF Corporation, Mt. Olive, N.J. The first group of compounds are formed by condensing ethylene oxide with a hydrophobic base formed by the condensation of propylene oxide with propylene glycol (see U.S. Pat. No. 2,674,619). The hydrophobic portion of the molecule which, of course, exhibits water insolubility, has a molecular weight from about 1500 to 1800. The addition of the polyoxyethylene radicals to this hydrophobic portion tends to increase the water solubility of the molecule as a whole and the liquid character of the product is retained up to the point where the polyoxyethylene content is about 50 percent of the total weight of the condensation product. The latter series of compounds called "PLURONIC-R®" are formed by condensing propylene oxide with the polyethoxylated ethylene glycol condensate. This series of compounds is characterized by having an average molecular weight of about between 2000 and 9000 consisting of, by weight, from about 10 to 80 percent polyoxyethylene, and a polyoxypropylene portion having a molecular weight between about 1000 and 3100.

U.S. Pat. Nos. 4,366,326; 4,624,803; 4,280,919; 4,340,766; 3,956,401; 5,200,236; 5,425,894; 5,294,365; incorporated by reference herein, describe in detail nonionic surfactants useful in the practice of this invention.

Finally, *Surfactant Science Series*, edited by Martin J. Schick, Nonionic Surfactants, Vols. 19 and 23 provide detailed description of nonionic surfactants and are incorporated by reference herein.

OTHER SURFACTANTS USEFUL IN THE COMPOSITIONS OF THE PRESENT INVENTION

The rinse aid compositions herein may also contain surfactants selected from the group of organic surfactants consisting of anionic, cationic, zwitterionic and amphoteric surfactants, and mixtures thereof. Said other surfactants are present at a level of 0 to 100% by weight, preferably 1 to 80% by weight, most preferably, 5 to 60% by weight. Surfactants useful herein are listed in U.S. Pat. No. 4,396,520 Payne et al., issued Aug. 2, 1983. U.S. Pat. No. 3,664,961, Norris, issued May 23, 1972 and in U.S. Pat. No. 3,919,678, Laughlin et al. issued Dec. 30, 1975, each of which is incorporated herein by reference. Useful cationic surfactants also include those described in U.S. Pat. No. 4,222,905, Cockrell, issued Sep. 16, 1980, and U.S. Pat. No. 4,239,659, Murphy, issued Dec. 16, 1980, both incorporated herein by reference.

Useful anionic surfactants include the water-soluble salts, preferably the alkali metal, ammonium and substituted ammonium salts, of organic sulfuric acid reaction products having in their molecular structure of alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzenesulfonates in which the alkyl group contains from about 9 to about 15 carbon atoms in straight chain or branched chain configuration, e.g., those of the type described in U.S. Pat. Nos. 2,220,099 and 2,477,383 both of which are incorporated herein by reference. Especially valuable are linear straight chain alkylbenzene sulfonates in which the average number of carbon atoms in the alkyl group is from 11 to 13, abbreviated as $C_{11-13}$LAS.

Other anionic surfactants suitable for use herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and from about 8 to about 12 carbon atoms in the alkyl group; and sodium or potassium salts of alkyl ethylene oxide ether sulfates containing from about 1 to about 25 units of ethylene oxide per molecule and from about 10 to about 20 carbon atoms in the alkyl group.

Other useful anionic surfactants include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 9 to about 23 carbon atoms in the alkyl group and from about 8 to 20 carbon atoms in the moiety.

Particularly preferred surfactants herein are anionic surfactants selected from the group consisting of the alkali metal salts of $C_{11-13}$ alkylbenzene sulfonates, $C_{12-18}$ alkyl sulfates, $C_{12-18}$ alkyl linear polyethoxy sulfates containing from about 1 to about 10 moles of ethylene oxide, and mixtures thereof and nonionic surfactants that are the condensation products of alcohols having an alkyl group containing from about 9 to about 15 carbon atoms with from about 4 to about 12 moles of ethylene oxide per mole of alcohol.

Cationic surfactants, useful in the practice of the present invention, comprise a wide variety of compounds characterized by one or more organic hydrophobic groups in the cation and generally by a quaternary nitrogen associated with acid radical. Quaternary nitrogen compounds also include nitrogen-containing ring compounds. Suitable anions are halides, methyl sulfate and hydroxide. Tertiary amines can have characteristics similar to cationic surfactants at washing solutions pH values less than about 8.5.

A more complete disclosure of cationic surfactants can be found in U.S. Pat. No. 4,228,044, issued Oct. 14, 1980, to Cambre, said patent being incorporated herein by reference.

Amphoteric surfactants, useful in the practice of the present invention, include derivatives of heterocyclic secondary and tertiary amines in which the aliphatic moiety can be straight chain or branched, and wherein one of the aliphatic substituents contains from about 8 to 18 carbon atoms and at least one aliphatic substituent contains an anionic water-solubilizing group.

HYDROTROPES

The compositions of the present invention also contain hydrotropes. Hydrotropes useful in the present invention include but are not limited to sodium xylene sulfonate, sodium cumene sulfonate, hexylene glycol, propylene glycol, dihexyl sodium sulfonate, and short chain alkyl sulfates. U.S. Pat No. 3,563,901 and U.S. Pat. No. 4,443,270 disclose useful hydrotropes and are incorporated by reference herein. Dihexyl sodium sulfosuccinate is a particularly preferred hydrotrope.

Hydrotropes are present at a level of 0 to 40% by weight, preferably at a level of 0.1 to 20% by weight and most preferably at a level of 1 to 10% by weight.

CO-POLYMERS OF ALKYLENE OXIDE ADDUCTS OF ALLYL ALCOHOL AND ACRYLIC ACID

Finally, the rinse aid compositions of the present invention contain copolymers of alkylene oxide adducts of allyl alcohol and acrylic acid having at least one of the following four formulas (I, II, III, IV):

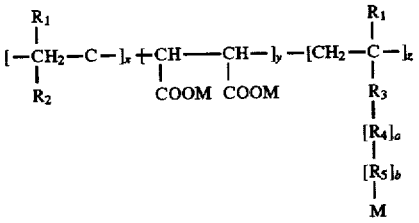

Formula I or

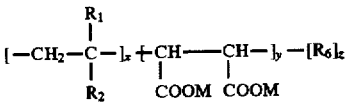

Formula II wherein x, y, z, a, and b are integers, (x+y):z is from about 5:1 to 1000:1, and y can be any value ranging from zero up to the value of x; M is an alkali metal or hydrogen; a:b is from about 1:4 to about 1:99;

$R_1$=H or $CH_3$;

$R_2$=COOM, $OCH_3$, $SO_3M$, O—CO—$CH_3$, CO—$NH_2$;

$R_3$=$CH_2$—O—, $CH_2$—N—, COO—, —O—,

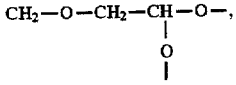

CO—NH—:

$R_4$=$C_3$ to $C_4$ alkyleneoxy group;

$R_5$=—$CH_2$—$CH_2$—O;

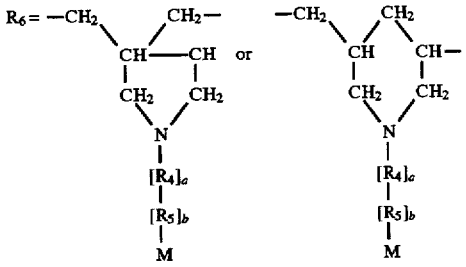

or mixtures of both;

The hydrophilic copolymer of the present invention is prepared by copolymerizing two monomers, an unsaturated hydrophilic monomer is copolymerized with an oxyalkylated monomer. These monomers may be randomly distributed within the polymer backbone.

Preferably, the unsaturated hydrophilic monomer component in formula I or II is acrylic acid.

Preferably, the oxyalkylated monomer component is a propylene oxide and ethylene oxide adduct of allyl alcohol having a molecular weight of about 3800. A preferred hydrophilic copolymer results from the polymerization of the acrylic acid monomer with the propylene oxide and ethylene oxide adduct of allyl alcohol, i.e., a copolymer of Formula I, where $R^1$=H, $R^2$=COOM, M=sodium, $R_3$=$CH_2$—O, and y=0; the value of a:b is preferably 1:5.

or

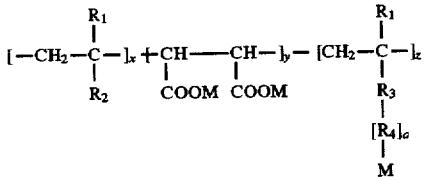

Formula III or

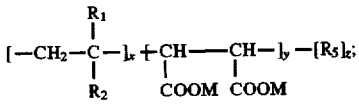

Formula IV wherein x, y and z are integers, (x+y):z is from about 5:1 to 1000:1, and y can be any value ranging from zero up to the value of x; M is an alkali metal or hydrogen; a is an integer from about 3 to about 680; and the hydrophilic and oxyethylated monomers may be in random order;

$R_1$=H or $CH_3$ $R_2$=COOM, $OCH_3$, $SO_3M$, O—CO—$CH_3$, CO—$NH_2$ $R_3$=$CH_2$—O—, $CH_2$—N—, COO—, —O—,

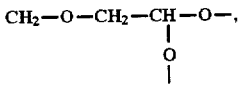

CO—NH—

$R_4$=—$CH_2$—$CH_2$—O

Where

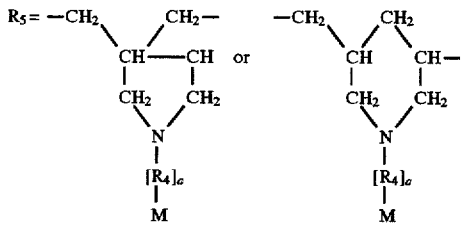

or mixtures of both.

The hydrophilic copolymer of the present invention is prepared by copolymerizing two monomers, an unsaturated hydrophilic monomer copolymerized with an oxyethylated monomer. These monomers may be randomly distributed within the polymer backbone.

Preferably, the unsaturated hydrophilic monomer component in Formula III or IV is acrylic acid. The preferred oxyethylated monomer is the ethylene oxide adduct of allyl alcohol, having a molecular weight of about 700, and $R_4$ is an oxyethylene group represented by $CH_2$—$CH_2$—O.

A preferred hydrophilic copolymer results from the polymerization of the acrylic acid monomer with the ethylene oxide adduct of allyl alcohol, i.e., copolymer of Formula III, where $R_1$=H, $R_2$=COOM, where M is sodium, $R_3$=$CH_2$—O, $R_4$ is —$CH_2$—$Ch_2$—O, y=0, and a is about 15.

A detailed description of these polymers useful in the practice of the present invention and their preparation is provided in U.S. Ser. No. 08/448,283 and U.S. Ser. No. 08/447,513, filed May 23, 1995, assigned to BASF, and both incorporated by reference herein. The co-polymers of the present invention are used at a level of 0.1 to 10% by weight in a rinse aid composition, preferably at a level of 0.1 to 8% by weight; most preferably 1 to 6% by weight.

The following Examples further describe and demonstrate the present invention. The Examples are given solely for the purpose of illustration, and are not to be construed as limitations of the present invention.

TESTING OF THE RINSE AID COMPOSITIONS OF THE PRESENT INVENTION

Detergent composition:

| Detergent composition: | |
|---|---|
| 34% | sodium tripolyphosphate |
| 18% | sodium carbonate |
| 25.5% | sodium metasilicate pentahydrate |
| 15% | caustic soda |
| 2.5% | chlorinated isocyanurate |
| 5% | water |
| Soil: | |
| 80% | margarine |
| 20% | powdered milk |

Five glasses were evaluated after five wash/rinse cycles in a Hobart UMP 4 dishwasher, using 200 ppm hardness water.

Cycle 1: 163.5 grams detergent, 40 grams soil.

Cycle 2: 13.6 grams detergent, 40 grams soil.

Cycle 3: repeat Cycle 2.

Cycle 4: repeat Cycle 3.

Cycle 5: repeat Cycle 4.

The glasses were visually rated on a scale of from one (spot and film free) to five (complete coverage spots and film).

EXAMPLE 1

A rinse aid composition of twenty percent by weight of a 2500 molecular weight block copolymer of ethylene oxide and propylene oxide, three percent by weight dihexylsodium sulfosuccinate hydrotrope, and seventy-seven percent by weight deionized water.

The rinse aid is injected at a rate such that the final rinse water contains 400 ppm rinse aid.

EXAMPLE 2

A rinse aid composition of twenty percent by weight of a 2500 molecular weight block copolymer of ethylene oxide and propylene oxide, three percent by weight dihexylsodium sulfosuccinate hydrotrope, two percent by weight of a partially neutralized 8000 molecular weight polymer of acrylic acid, and seventy-five percent by weight deionized water.

The rinse aid is injected at a rate such that the final rinse water contains 400 ppm rinse aid.

EXAMPLE 3

A rinse aid composition of twenty percent by weight of a 2500 molecular weight block copolymer of ethylene oxide and propylene oxide, three percent by weight dihexyl sodium sulfosuccinate hydrotrope, two percent by weight of a modified polymer of acrylic acid prepared according to the method described herein on page 21–22 of the specification (polymer of the present invention); and seventy-five percent by weight deionized water.

The rinse aid is injected at a rate such that the final rinse water contains 400 ppm rinse aid.

EXAMPLE 4

Example 2 was repeated, except that a modified acrylic acid polymer prepared according to the method of Example 3, but with a weight ratio of acrylic acid to polyether of 86:14 was used (polymer of the present invention).

The rinse aid compositions were evaluated for stability and effectiveness at minimizing spotting-and-filming on glassware.

The rinse aid is injected at a rate such that the final rinse water contains 400 ppm rinse aid.

PREPARATION OF ALKYLENE OXIDE ADDUCT OF ALLYL ALCOHOL (I)

To a suitable reaction vessel was added a homogenous mixture of 396.2 grams allyl alcohol and 44.1 grams potassium t-butoxide. The vessel was sealed, purged with nitrogen and pressurized to 90 psig. The pressure was relieved to 2 psig and the temperature of the vessel adjusted to 80° C. The first 125 grams of propylene oxide was added over a 1 hour. The temperature was maintained between 75°–85° C. and the pressure was maintained at <90 psig. The next 200 grams of propylene oxide was added over 1 hour at 75°–85° C. and <90 psig pressure. The next 400 grams of propylene oxide was added over 1 hour at 100°–110° C. and <90 psig pressure. The remaining 4551.2 grams of propylene oxide was added at 500 grams per hour and at 120°–130° C. and <90 psig pressure. After all of the propylene oxide was added, the mixture was reacted at 125° C. for 2 hours and the vessel was vented to 0 psig. After removal of volatiles under vacuum, and cooling 50° C., the sample was discharged into an intermediate holding tank for analysis.

To a suitable reaction vessel was added 2696.8 grams of the allyl alcohol propylene oxide intermediate. The vessel was sealed and pressurized to 90 psig with nitrogen and vented to 2 psig. This was repeated two more times. The temperature was adjusted to 145° C. and the pressure was readjusted to 34 psig with nitrogen. 10788.9 grams ethylene oxide was added at 1400 grams per hour. The temperature was maintained at 140°–150° C. and the pressure was maintained at <90 psig. If the pressure rose above 85 psig, the ethylene oxide addition was slowed. If this failed to lower the pressure, the addition was halted and allowed to react at 145° C. for 30 minutes. The vessel was slowly vented to 0 psig and repressurized to 34 psig with nitrogen. The addition was continued at 140°–150° C. and <90 psig pressure. After all of the ethylene oxide was added, the material was held at 145° C. for 1 hour. After cooling to 90° C., 14.3 grams of 85% phosphoric acid was added. After mixing for 30 minutes, the temperature was lowered to 100° C. and volatiles removed under vacuum. The batch was cooled at 70° C. and discharged into a holding tank. The product was found to have a number average molecular weight of 4091 by phthalic anhydride esterification in pyridine.

POLYMERIZATION OF I WITH ACRYLIC ACID

To a two liter, four-necked flask equipped with a mechanical stirrer, reflux condenser, thermometer, and outlet for feed lines, were added 301 grams of distilled water and 2.6 grams of 70% phosphorous acid. After heating to 95° C., a monomer blend of 555.4 grams of glacial acrylic acid and 61.7 grams of an allyl alcohol initiated propoxylate ethoxylate (I) (molecular weight @3500), a redox initiator system consisting of 132 grams of a 38% sodium bisulfite solution and 155.4 grams of a 10.9% sodium persulfate solution, are fed into the flask linearly and separately while maintaining the temperature at 95°±3° C . The sodium bisulfite solution and monomer blend feeds are added over 4 hours while the sodium persulfate solution is added over 4.25 hours. The three feeds are added via TEFLON® ⅛ inch tubing lines connected to rotating piston pumps. Appropriately sized glass reservoirs attached to the pumps hold the monomer blend and initiator feeds on balances accurate to 0.1 gram to precisely maintain feed rates. When the additions are complete, the system is cooled to 80° C. and 25.3 grams of 2.4% 2,2'-azobis (N,N'-dimethyleneisobutylamidine) dihydrochloride solution is added over 0.5 hours as a post-polymerizer. When addition is complete the system is reacted for 2 hours. After reaction, the system is cooled to 60° C. and the solution pH is adjusted to about 7 with the addition of 658 grams of 50% sodium hydroxide solution. The resultant pH 7 polymer solution has an approximate solids content of 40%.

Table 1 serves to illustrate the superior benefits of the present invention over the prior art. Clearly, spotting and filming is reduced when co-polymers of the present invention (Examples 3 & 4) are used.

TABLE 1

| EXAMPLE | APPEARANCE | SPOTTING AND FILMING |
|---|---|---|
| 1 | clear | 3.5 |
| 2 | clear | 2.8 |
| 3 | clear | 2.6 |
| 4 | clear | 2.6 |

In conclusion, the rinse aid compositions of the present invention are effective at minimizing the spotting-and-filming of glassware under hard water conditions and do not require additional high cloud point nonionic surfactants and/or polymers to provide stability.

What is claimed is:

1. A rinse aid composition consisting of by weight:

(a) 1 to 80% nonionic surfactants;

(b) 0.1 to 20% dihexylsodium sulfosuccinate hydrotrope;

(c) 0.1 to 10% copolymers of alkylene oxide adducts of allyl alcohol and acrylic acid selected from Formula I, II, III, or IV:

Formula I

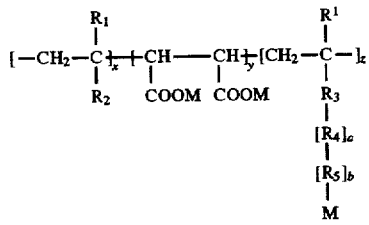

or

Formula II

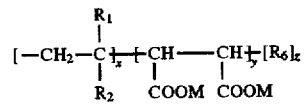

wherein x, y, z, a, and b are integers, (x+y):z is from about 5:1–1,000:1, and y can be any value ranging from zero up to the value of x; M is an alkali metal or hydrogen; a:b is from about 1:4 to about 1:99;

$R_1$=H or $CH_3$;

$R_2$=COOM, $OCH_3$, $SO_3M$, O—CO—$CH_3$, CO—$NH_2$;

$R_3$=$CH_2$—O—, $CH_2$—N—, COO—, —O—,

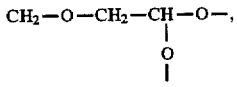

CO—NH—;

$R_4$=$C_3$ to $C_4$ alkyleneoxy group;

$R_5$=$CH_2$—$CH_2$—O;

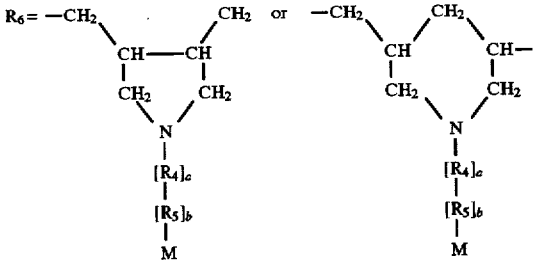

or mixtures of both;

or

Formula III

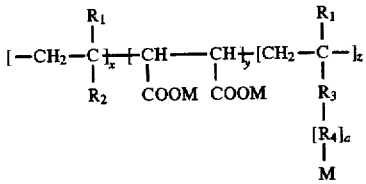

-continued or

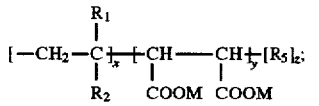

Formula IV wherein x, y and z are integers, (x+y):z is from about 5:1–1,000:1, and y can be any value ranging from zero up to the value of x; M is an alkali metal or hydrogen; a is an integer from about 3 to about 680; and the hydrophilic and oxyethylated monomers may be in random order;

$R_1$=H or $CH_3$;

$R_2$=COOM, $OCH_3$, $SO_3M$, O—CO—$CH_3$, CO-$NH_2$;

$R_3$=$CH_2$—O—, $CH_2$—N—, COO—, —O—,

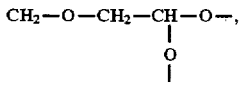

CO—NH—;

$R_4$=—$CH_2$—$CH_2$—O;

Where

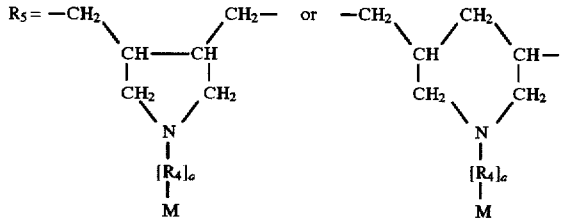

or mixtures of both.

2. A rinse aid composition according to claim 1, wherein (c) is Formula I

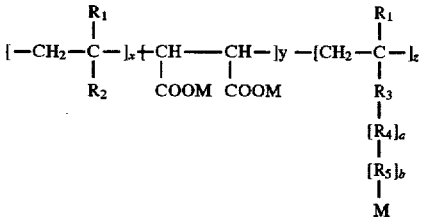

and wherein further, $R_1$=H; $R_2$=COOM; M=sodium; $R_3$=$CH_2$—O; y=0; a:b is about 1:5.

3. A rinse aid composition according to claim 1, wherein (c) is Formula III

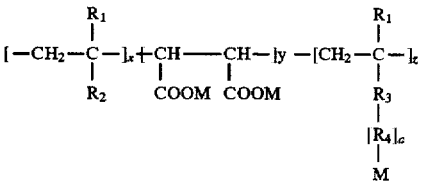

wherein further, $R_1$=H; $R_2$=COOM; M=sodium; $R_3$—$CH_2$—O; $R_4$ is $CH_2$—$CH_2$—O; y=0; a is about 15.

4. A method of reducing spotting and filming of dishware comprising contacting said dishware with a rinse aid composition consisting of by weight:

(a) 1 to 80% nonionic surfactants;

(b) 0.1 to 20% hydrotropes;

(c) 0.1 to 10% copolymers of alkylene oxide adducts of allyl alcohol and acrylic acid selected from Formula I, II, III, or IV;

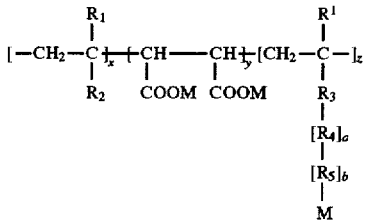

Formula I or

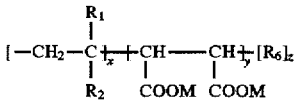

Formula II wherein x, y, z, a, and b are integers, (x+y):z is from about 5:1 –1,000:1, and y can be any value ranging from zero up to the value of x; M is an alkali metal or hydrogen; a:b is from about 1:4 to about 1:99;

$R_1$=H or $CH_3$;

$R_2$=COOM, $OCH_3$, $SO_3M$, O—CO—$CH_3$, CO—$NH_2$;

$R_3$=$CH_2$—O—, $CH_2$—N—, COO—, —O—,

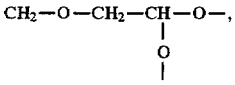

CO—NH—;

$R_4$=$C_3$ to $C_4$ alkyleneoxy group;

$R_5$=—$CH_2$—$CH_2$—O;

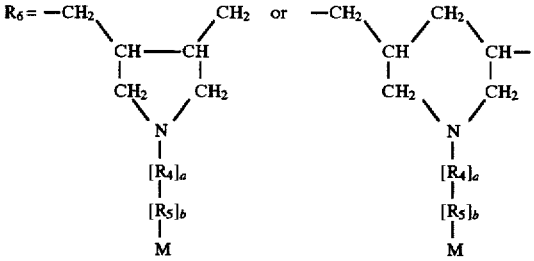

or mixtures of both;

or

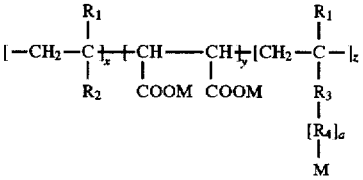

Formula III or

-continued

Formula IV

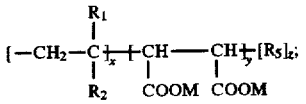

wherein x, y and z are integers, (x+y):z is from about 5:1–1,000:1, and y can be any value ranging from zero up to the value of x; M is an alkali metal or hydrogen; a is an integer from about 3 to about 680; and the hydrophilic and oxyethylated monomers may be in random order;

$R_1$=H or $CH_3$;

$R_2$=COOM, $OCH_3$, $SO_3M$, O—CO—$CH_3$, CO—$NH_2$;

$R_3$=$CH_2$—O—, $CH_2$—N—, COO—, —O—,

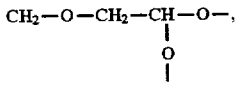

CO—NH—

$R_4$=—$CH_2$—$CH_2$—O;

Where

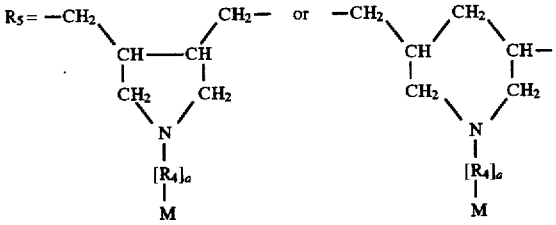

or mixtures of both.

5. A method for reducing spotting and filming of dishware according to claim 4, wherein (c) is Formula I:

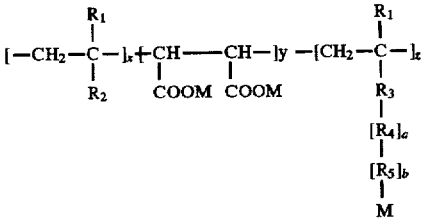

and wherein further, $R_1$=H; $R_2$=COOM; M=sodium; $R_3$=$CH_2$—O; y=0; a:b is about 1:5.

6. A method according to claim 4, wherein (c) is Formula III:

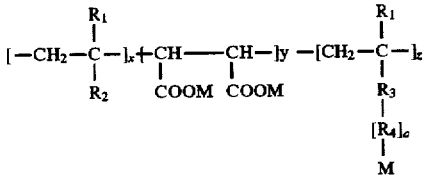

wherein further, $R_1$=H; $R_2$=COOM; M=sodium; $R_3$—$CH_2$—O; $R_4$ is $CH_2$—$CH_2$—O; y=0 ; a is about 15.

* * * * *